US005426419A

United States Patent [19]

Nguyen et al.

[11] Patent Number: 5,426,419

[45] Date of Patent: Jun. 20, 1995

[54] SECURITY TAG HAVING ARCUATE CHANNEL AND DETACHER APPARATUS FOR SAME

[75] Inventors: Thang t. Nguyen, Boca Raton; Elbert W. Dooley, Jr., Lake Worth; Hans P. Witzky, Pompano; Norman Hansen, Highland Beach, all of Fla.

[73] Assignee: Sensormatic Electronics Corporation, Deerfield Beach, Fla.

[21] Appl. No.: 4,592

[22] Filed: Jan. 14, 1993

[51] Int. Cl.[6] ..... G08B 13/14; E05B 65/00

[52] U.S. Cl. ..... 340/572; 70/57.1

[58] Field of Search ..... 340/572, 551; 70/57.1, 70/391, 416, 453, 454; 24/704.1, 704.2

[56] References Cited

U.S. PATENT DOCUMENTS

| | | | |
|---|---|---|---|
| 3,914,829 | 10/1975 | Paskert | 340/572 X |
| 3,942,829 | 3/1976 | Humble et al. | 70/57.1 |
| 3,947,930 | 4/1976 | Martens et al. | 340/572 |
| 3,974,581 | 8/1976 | Martens et al. | 340/572 |
| 4,221,025 | 9/1980 | Martens et al. | 70/57.1 |
| 4,311,992 | 1/1982 | DeChant | 340/572 |
| 5,031,756 | 7/1991 | Buzzard et al. | 206/1.5 |
| 5,039,982 | 8/1991 | Bruhwiler | 340/572 |

*Primary Examiner*—John K. Peng
*Assistant Examiner*—Thomas J. Mullen, Jr.
*Attorney, Agent, or Firm*—Robin, Blecker, Daley & Driscoll

[57] ABSTRACT

An EAS tag in which the tag is held to an article by an attaching assembly a part of which is releasably prevented from being withdrawn from the body of the tag. The tag body is provided with an arcuate channel through which an arcuate detacher probe can be guided for releasing the attaching assembly part. A spring clamp provides the releasable preventing function and includes jaws specifically adapted to respond to in-plane torsional forces provided by the arcuate probe which is moved through the arcuate channel by rotation to reach the spring clamp. Hand and power actuated detacher assemblies incorporating the arcuate probe are also provided.

46 Claims, 14 Drawing Sheets

SECURITY TAG HAVING ARCUATE CHANNEL AND DETACHER APPARATUS FOR SAME

BACKGROUND OF THE INVENTION

This invention relates to security tags and associated detachers and, more particularly, to a security tag and an associated detacher for use in an electronic article surveillance (EAS) system.

Electronic article surveillance systems are well known in the art and are used for inventory control and to prevent theft and similar unauthorized removal of articles from a controlled area. Typically, in such systems a system transmitter and a system receiver are used to establish a surveillance zone which must be traversed by any articles being removed from the controlled area.

An EAS tag is affixed to each article and includes a marker or sensor adapted to interact with a signal being transmitted by the system transmitter into the surveillance zone. This interaction causes a further signal to be established in the surveillance zone which further signal is received by the system receiver. Accordingly, upon movement of a tagged article through the surveillance zone, a signal will be received by the system receiver, identifying the unauthorized presence of the tagged article in the zone.

Certain types of EAS tags have been designed to be reusable and, thus, include releasable attachment devices for affixing the tags to the articles. Such attachment devices are further designed to be releasable by authorized personnel only so that unauthorized removal of a tag from its article is avoided. To this end, many attachment devices are made releasable only through the use of an associated special tool or detaching mechanism.

An EAS tag employing an attachment device and an associated detacher is described in U.S. Pat. No. 3,942,829, entitled REUSABLE SECURITY TAG, issued to Humble, et al. on Mar. 9, 1976 and assigned to same assignee hereof. The EAS tag of the '829 patent includes a tag body and an attachment device in the form of a tack assembly. The tack assembly includes an enlarged head and a tack body having a pointed end which serves to pierce through an article and to be receivable in and clamped to the tag body. This secures the article and tag together.

In the tag of the '829 patent, the tack is clamped to the tag body using a spring clamp formed as a clutch lock with spreadable jaws. Once the article is pierced, the pointed tack end is received in the tag body and is secured between the jaws of the clutch lock. This locks the tack and the tag body forming the EAS tag to the article so that the tag and article cannot be readily separated from each other.

In order for authorized personnel to be able to release the tack from the clutch lock and, therefore, the tag from the article, the '829 patent utilizes a detacher mechanism which is adapted to grip the tag body and apply a bending force thereto. This force is sufficient to deform the clutch lock so that the jaws of the clutch lock are spread apart, thereby releasing the tack. The tack can then be removed from the tag body so that the article and tag become separated from one another.

To permit the bending of the tag body sufficiently to deform the clutch lock, the tag body of the '829 patent must be made of a flexible material. Typically, flexible plastic materials such as, for example, polypropylene, have been used. Such materials, however, are susceptible to being cut and damaged. This tends to be a disadvantage, since it increases the likelihood that the locking feature of the tag can be separated from the EAS sensor part of the tag or can be exposed and defeated.

Moreover, the tag body of the '829 patent must be relatively large in size in order to facilitate its flexing. This likewise tends to be a disadvantage, since use of large tags detracts from the aesthetic appearance of the articles to which the tags are attached.

Another type of EAS security device is known in which a variation of the spring clamp of the '829 patent has been incorporated into a so-called keeper for a compact disc. This type of device is disclosed in U.S. Pat. No. 5,031,756, entitled KEEPER FOR COMPACT DISC PACKAGE OR THE LIKE, issued to Buzzard, et al. on Jul. 16, 1991 and also assigned to same assignee hereof.

The keeper of the '756 patent comprises a rigid plastic frame. One side of the frame is provided with an enlarged section which houses a tack-like button assembly and a spring clamp as in the '829 patent. In this case, the spring clamp is used to lock the button assembly in a first position. In this position, the pointed end of the button assembly protrudes into the frame to pierce and hold to the frame a cardboard container containing a compact disc. As a result, unauthorized removal of the compact disc with the frame causes an EAS sensor also incorporated into the frame, to generate a detectable signal for alarming an EAS system.

In the keeper of the '756 patent, the enlarged section of the frame is provided with opposing linear slots which lead to the region between the jaws of the spring clamp. By inserting ramped linear fingers into these slots, the fingers are guided into this region, causing the jaws to flex outward. This releases the button enabling it to be withdrawn from the cardboard container. The container and its housed compact disc can then be separated from the frame.

While the keeper of the '756 patent utilizes a spring clamp of the '829 patent type in a rigid frame, it also has certain drawbacks. One drawback is that the linear slots leading to the spring clamp permit in-line viewing and access to the clamp. This increases the susceptibility of the clamp to defeat, since linear objects can be inserted into the slots in an attempt to open the jaws. Another drawback is that the fingers of the detacher are required to be of high precision, since they must be received in the region between the spring clamp jaws. This increases the cost and complexity of the detacher.

It is, therefore, an object of the present invention to provide an EAS tag which does not suffer from the above disadvantages.

It is a further object of the present invention to provide an EAS tag having a hard tag body and which is adapted to be releasable from an article in an easy and simple manner.

It is also an object of the present invention to provide an EAS tag as set forth in the previous objectives and which is further adapted to be more difficult to defeat.

It is yet a further object of the present invention to provide a detacher for use in detaching the EAS tags set forth in the previous objectives.

SUMMARY OF THE INVENTION

In accordance with the principles of the present invention, the above and other objectives are realized in an EAS tag of the above-described type in which the tag is provided with a tag body and with an attaching means for attaching the tag body to an article. The attaching means includes a part which is receivable in the tag body and the tag body is provided with further means for releasably preventing withdrawal of the attaching means part.

Channel defining means within the tag body defines an arcuate channel. This channel leads to the preventing means and permits an arcuate probe to be guided to such means for releasing same. Release of the preventing means permits withdrawal of attaching means part thereby separating the attaching means and article from the tag body.

In the embodiment of the invention to be disclosed hereinafter, the attaching means comprises a tack having a head and a tack body, the latter being the part of attaching means receivable in the tag body through a first opening. The preventing means includes a receiving and clutching means which receives and clutches the tack body, thereby preventing withdrawal of the tack body from the tag body. A release part of the receiving and clutching means when engaged causes the receiving and clutching means to release, thereby allowing withdrawal of the tack body. A second opening in the tag body leads to the arcuate channel which, in turn, leads to the release part of the receiving and clutching means to allow the arcuate probe to engage same to effect the release.

In a further aspect of the invention, a unique spring clamp is utilized for the receiving and clutching means. This spring clamp includes a clamp body and jaws which extend from the plane of the clamp body. A first area of the clamp body on one side of the jaws is adapted to permit the clamp body to be mounted in the tag body, while a second area of the clamp body on the other side of the jaws is adapted to receive a torsional force in the plane of the clamp body. The jaws of the spring clamp are further adapted such that the in-plane torsional force on the second area of the clamp body enables opening of the jaws and release of the spring clamp.

In the embodiment of the spring clamp to be disclosed hereinbelow, the jaws are integral with the clamp body and comprise first and second sections which extend out of the plane of the spring clamp and then toward each other terminating in spaced edges which extend to a common edge of the spring clamp. The first and second areas of the spring clamp also extend to this common edge and laterally outward of the first and second sections, respectively. An aperture in the first area permits pivotal mounting of the spring clamp body and an elongated spring arm is attached to a further edge of the clamp body opposite the common edge. The spring arm returns the clamp body to its initial position after rotation or pivoting of the clamp body as a result of the in-plane torsional force.

In yet a further aspect of the present invention, a detacher mechanism is provided for detaching the EAS tag of the invention from an article. The detacher comprises an arcuate probe which is adapted to be received in the arcuate channel of the tag. Means is further provided for moving the arcuate probe so that it is received in and withdrawn from the channel. This moving means is adapted to rotate the probe, while support means supports the tag in proper relationship to the probe.

Hand actuated and power actuated/tag activated detacher embodiments are disclosed. The hand actuated detacher includes a hand actuatable button and a mechanical linkage linking the button and the probe driving means. The tag actuated detacher includes motor means for driving the probe, electronics for controlling the motor and sensors for detecting the position of the tag and probe.

BRIEF DESCRIPTION OP THE DRAWINGS

The above and other features and aspects of the present invention will become more apparent upon reading the following detailed description in conjunction with the accompanying drawings, in which.

DETAILED DESCRIPTION

FIGS. 1–7 show various views of an EAS tag 1 in accordance with the principles of the present invention. As shown (see, FIG. 1), the tag 1 includes an upper housing 2 having side walls 2A, 2B, 2C and 2D which are joined by a top wall 2E. The tag 1 also includes a lower housing 3 having side walls 3A, 3B, 3C and 3D which are joined by a bottom wall 3E. The upper and lower housings 2 and 3 are joined or mated along corresponding or associated side wall pairs (2A, 3A), (2B, 3B), (2C, 3C) and (2D, 3D) to form a closed tag body 1A.

The housings 2 and 3 are preferably made of a hard or rigid material. A usable rigid or hard material might be a hard plastic such as, for example, an injection molded ABS plastic. If a plastic is used, the mating side walls of the housings can be joined by an ultrasonic weld 1B or like joining mechanism.

Figure 1:
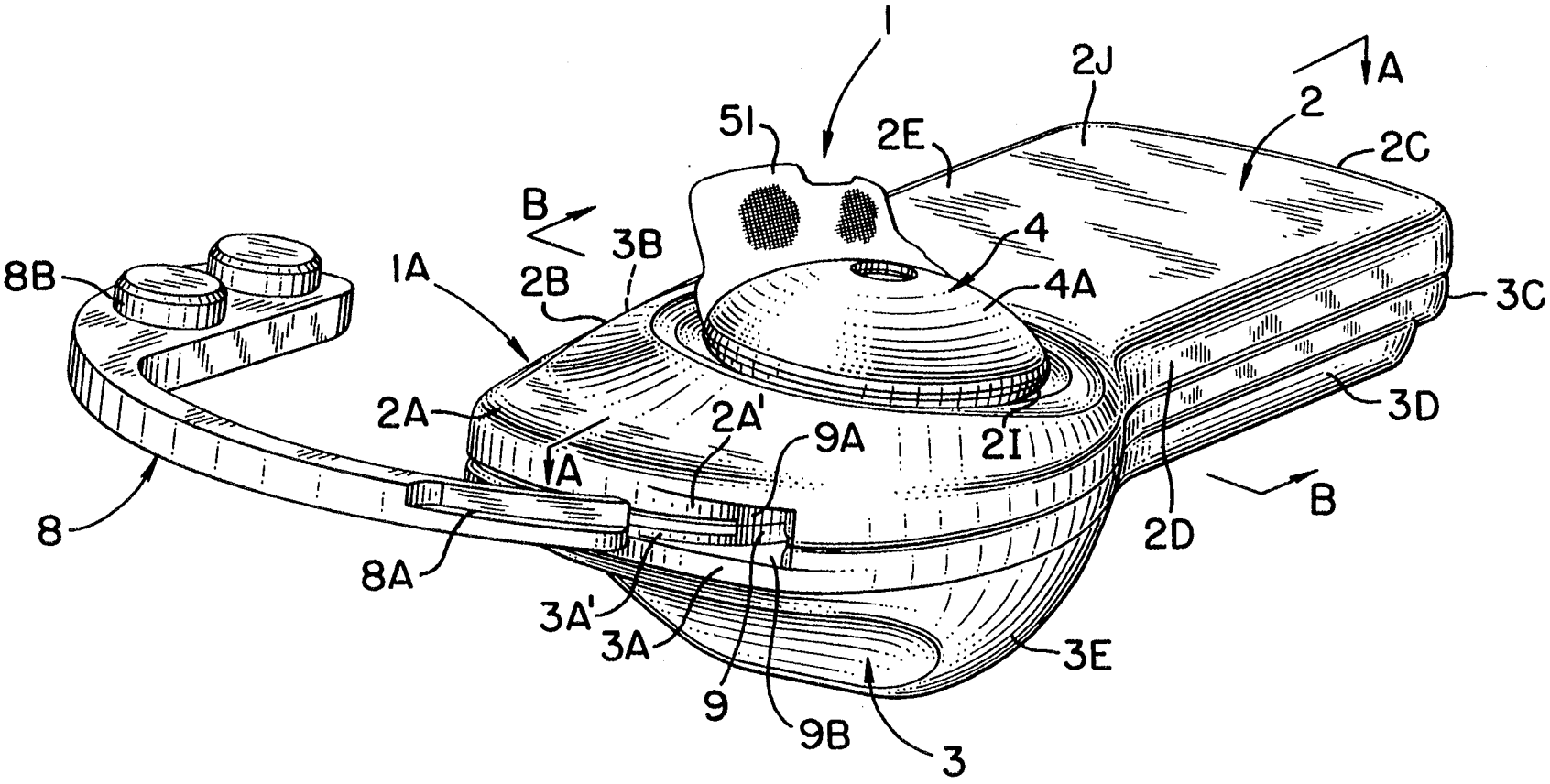
FIG. 1 shows an EAS tag and associated detacher probe in accordance with the principles of the present invention.
Figure 2:
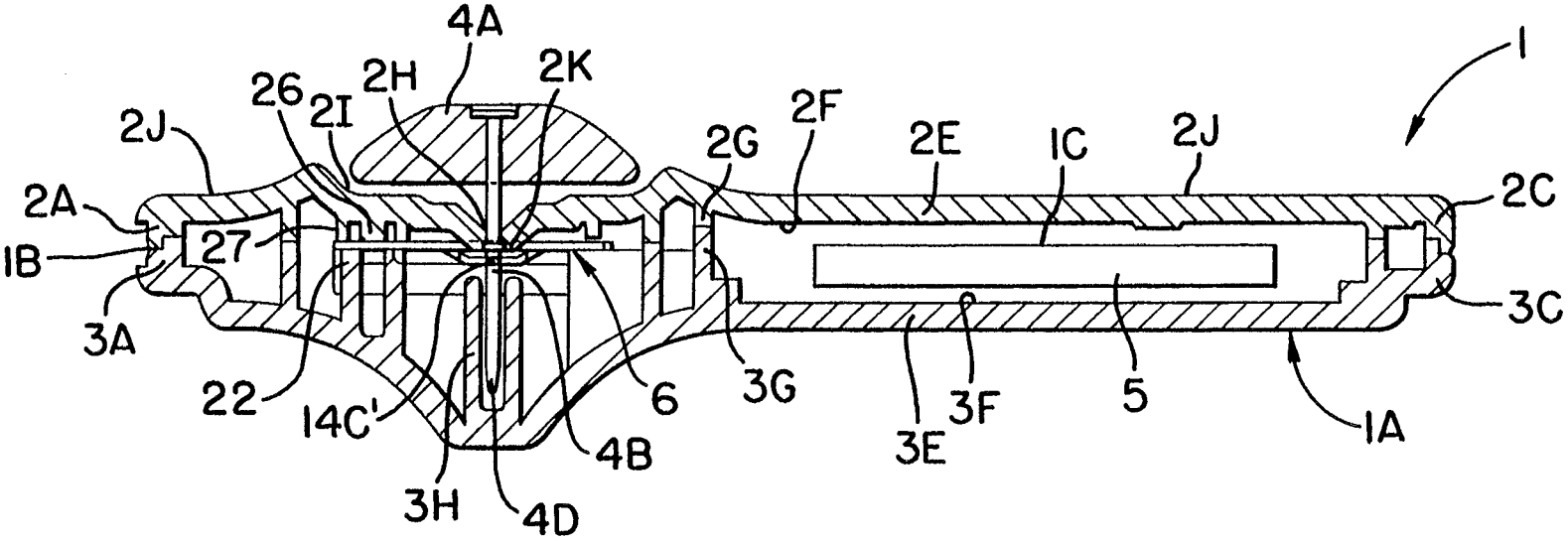
FIG. 2 shows a cross-section of the EAS tag of FIG. 1 taken along the line A—A in FIG. 1.
Figure 6A:
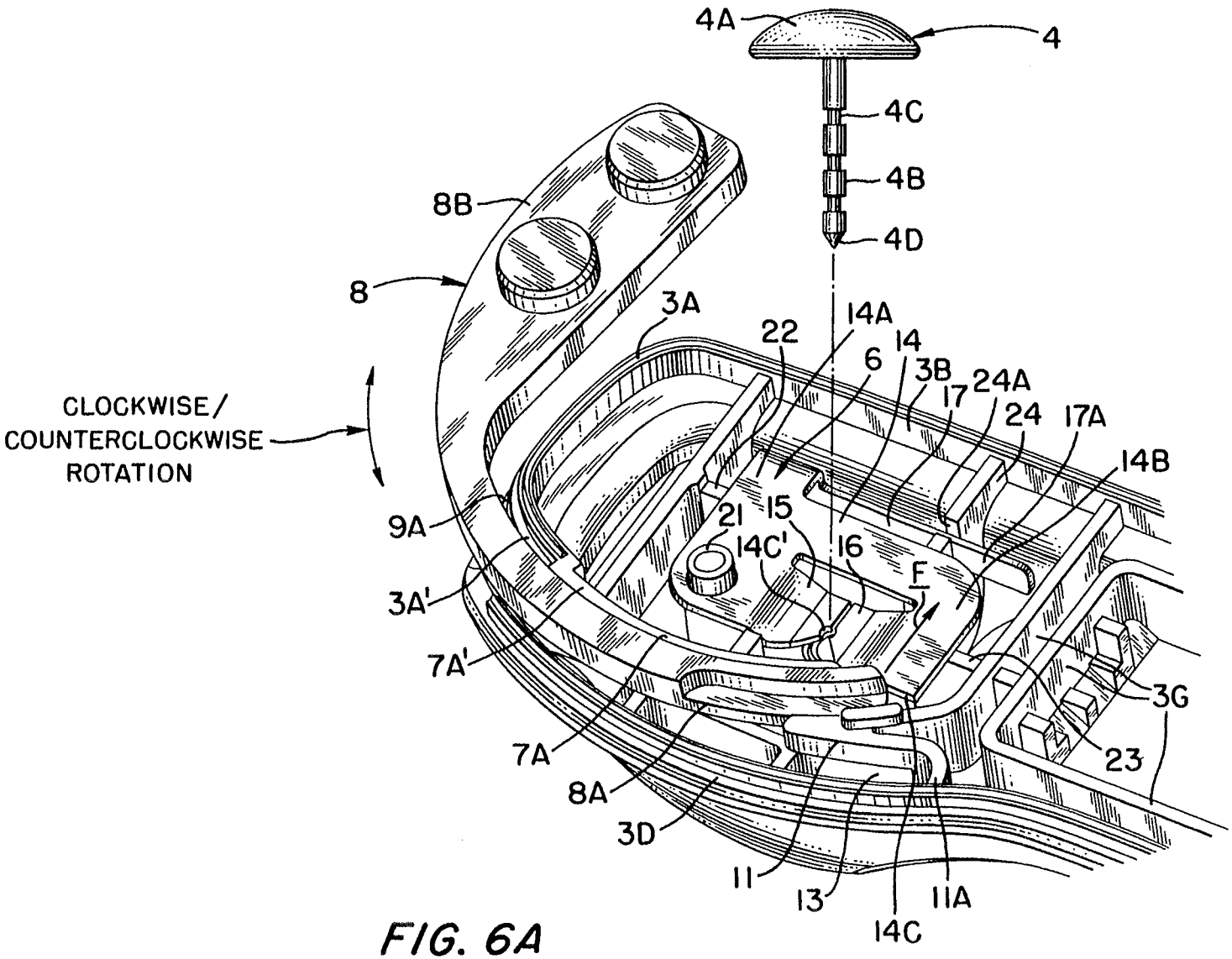
FIGS. 6A and 6B show partial views of the interior of the lower housing of the EAS tag of FIG. 1 with the probe inserted in and withdrawn from the arcuate channel of the tag, respectively.

The tag 1 further includes a tack assembly 4 shown as having an enlarged tack head 4A and an elongated tack body 4B provided with slots or grooves 4C and a pointed forward end 4D (see, FIGS. 1, 2 and 6A). The tack assembly 4 is used to attach the tag body 1A to an article 51 which is to be protected by the EAS tag 1.

Figure 3:
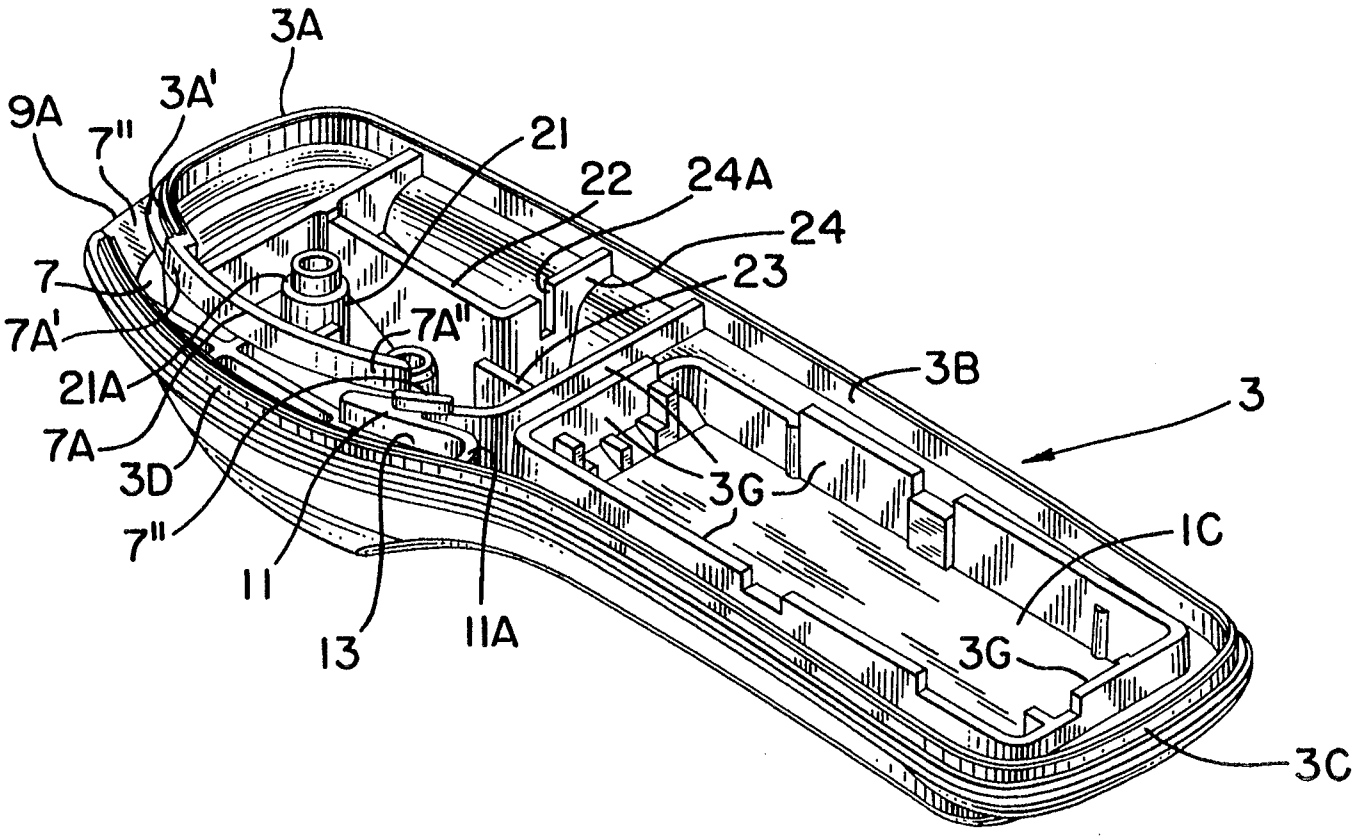
FIG. 3 shows a view of the interior of the lower housing of the EAS tag of FIG. 1.
Figure 4B:
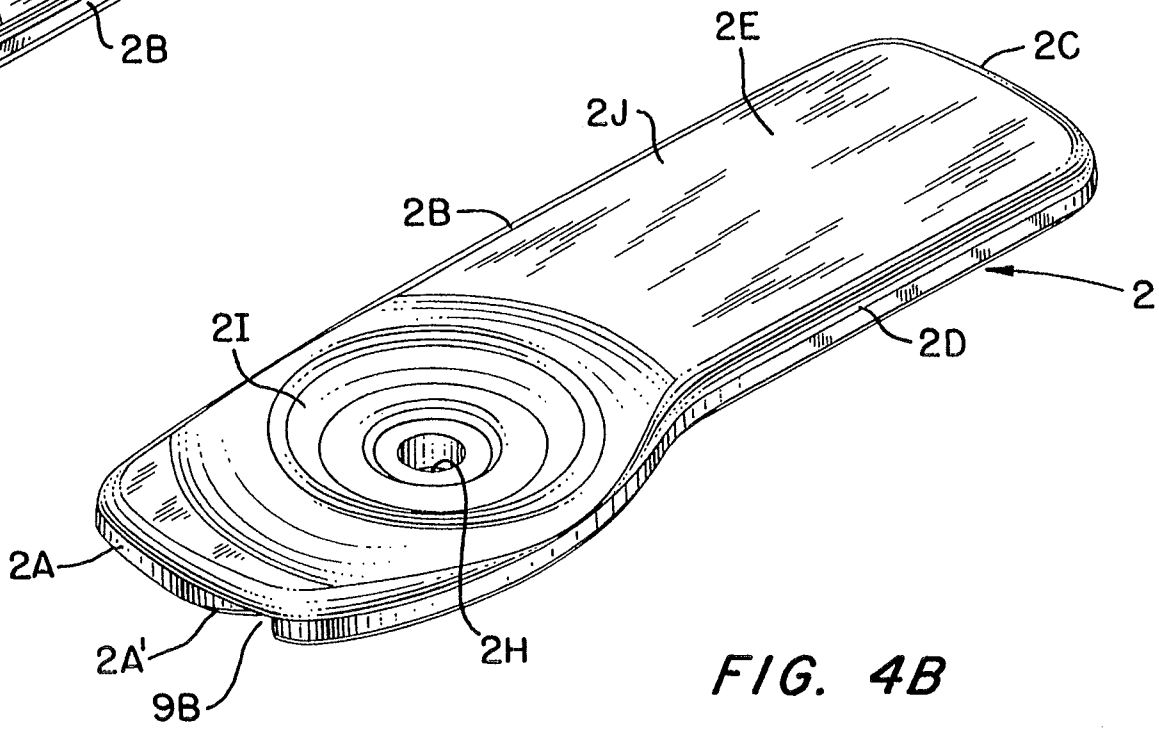
FIG. 4B shows a view of the exterior of the upper housing of the EAS tag of FIG. 1.
Figure 4A:
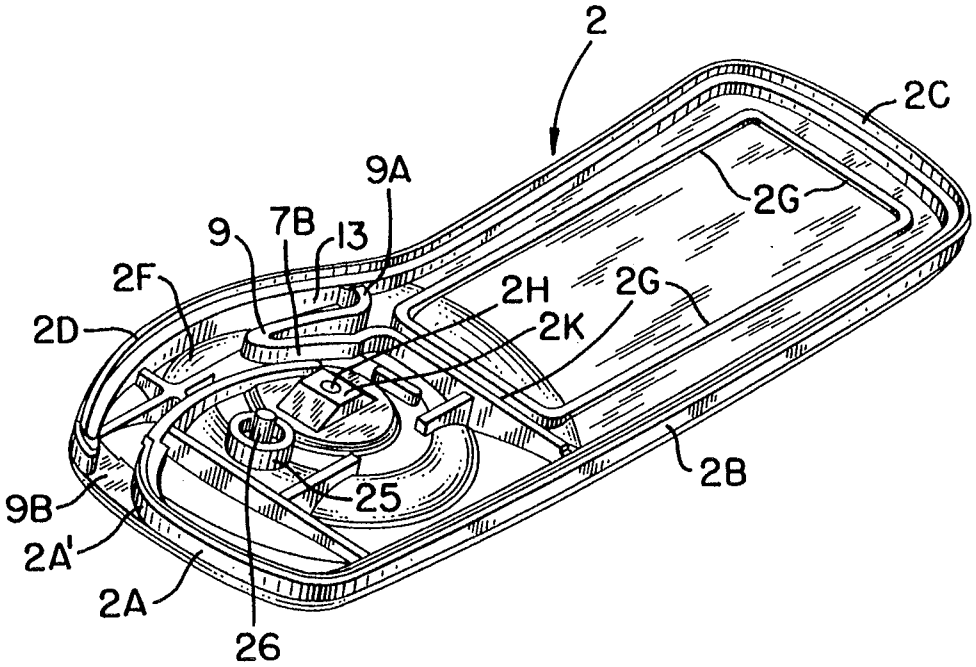
FIG. 4A shows a view of the interior of the upper housing of the EAS tag of FIG. 1.
Figure 5:
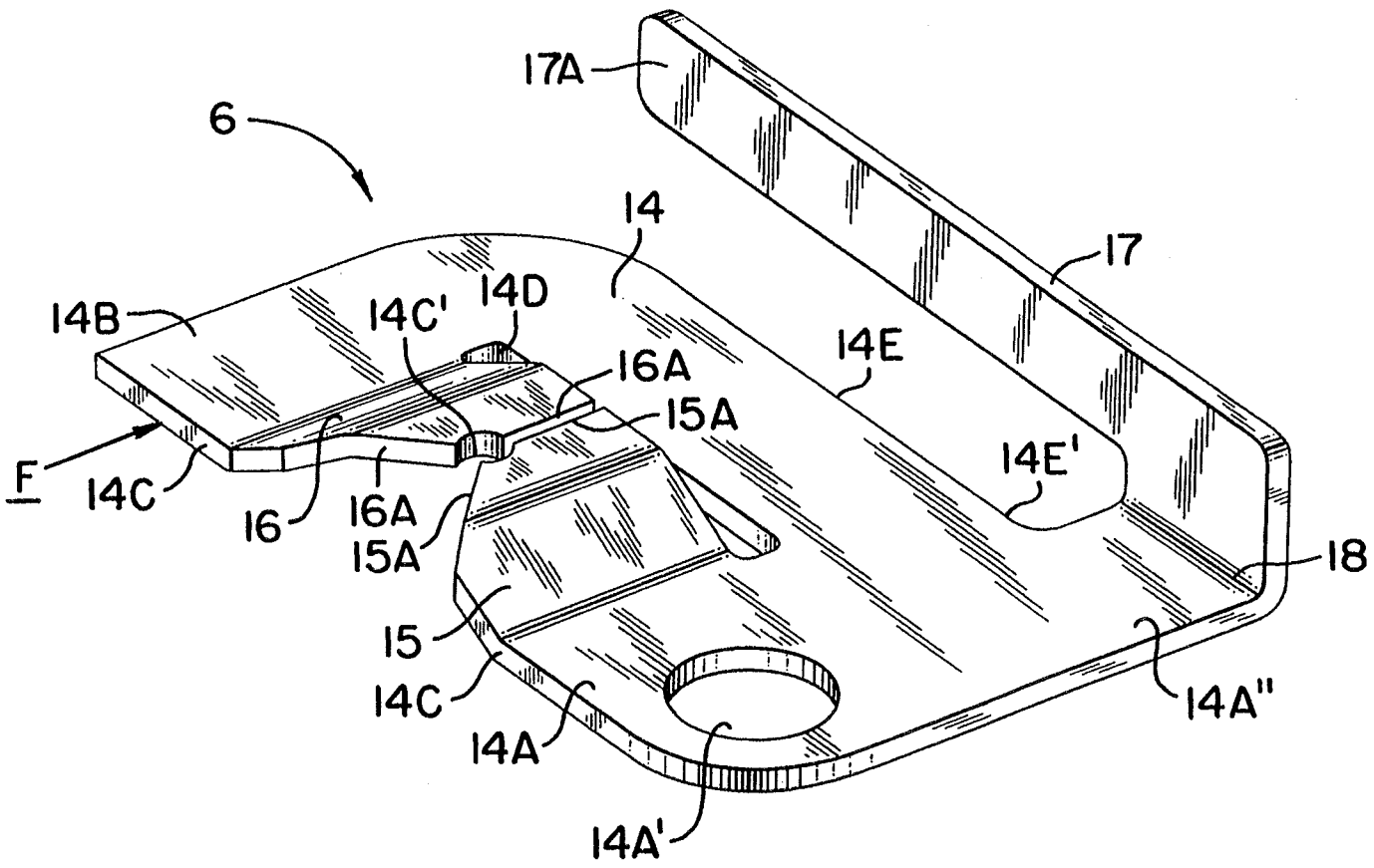
FIG. 5 illustrates an exploded view of the spring clamp used in the EAS tag of FIG. 1.

In order to sense the tag 1 and, therefore, detect the presence of the tag and the attached article 51, the inner surfaces 2F and 3F of the walls 2E and 3E of the housings 2 and 3 are provided with frame members 2G and 3G which together define an interior cavity 1C for receiving an EAS sensor 5 (see, FIGS. 2, 3 and 4A). The EAS sensor 5 generates detectable signals and can be an acoustically resonant magnetic sensor as disclosed in U.S. Pat. Nos. 4,510,489 and 4,510,490. Possible other magnetic EAS sensors usable for the sensor 5 might be those disclosed in U.S. Pat. Nos. 4,686,516 and 4,797,658 and possible RF EAS sensors might be those disclosed in U.S. Pat. Nos. 4,429,302 and 4,356,477. The teachings of these patents are incorporated herein by reference.

As above-noted, the article 51 is joined to the tag body 1A by the tack assembly 4. This is accomplished by inserting the tack body 4B into an opening 2H in the wall 2E of the upper housing 2. When the tack body 4B is fully inserted, the pointed end 4D of the tack is received in an upstanding cavity or collar 3H extending from the inner surface 3F of the lower housing wall 3E. The tack head 4A, in turn, seats in a recessed area 2I in the upper surface 2J of the wall 2E. The article 51 is thus held between the tack head 4A and the latter wall.

Means 6 to be discussed in greater detail below is provide within the tag body 1A for releasably preventing the tack body from being withdrawn from the tag body. The tack assembly 4B the article 51 thus become releasably locked to the EAS tag by the means 6.

In accordance with the principles of the present invention, the EAS tag 1 is further adapted so that access to the means 6 for releasing same is made difficult for other than authorized personnel. To this end, the tag body 1A is configured so that access to the means 6 is through an arcuate channel 7 (see FIGS 1, 3, 4A, 4B, 6A and 6B) defined by one or more inner walls and by parts of the side walls and upper and lower walls of the tag body 1A. With this configuration, a special arcuate probe 8 is needed to reach and release the means 6 and, thus, detach the tack assembly 4 and the article from the tag body 1A.

As shown, the arcuate channel 7 is defined by a curved inner wall 7A. This wall extends upward from the inner surface 3F of the bottom housing 3 to abut the inner surface 2F of the upper housing 2. The wall 7A is further spaced from the side wall 3D of the bottom housing 3 and its outward end 7A' terminates at an inward curved part 3A' of the side wall 3A. The inward curved part 3A' of the wall 3A results in a space or slot 9A between the side walls 3A and 3D of the lower housing 3.

The slot 9A cooperates with a similar slot 9B between the sides wall 2A and 2D of the upper housing 2 to define a second opening 9 for providing entry or access into the outward end 7' of the channel 7. At this entry point, the side wall 2A also curves inwardly at a part 2A', the latter part 2A' mating with the curved side wall part 3A' of the side wall 3 of the lower housing 3.

The channel 7 is further defined by a second curved wall 7B (see, FIGS. 4A and 7) extending downwardly from the inner surface 2F of the upper housing 2. The wall 7B is situated outward of the inner end 7A'' of the curved wall 7A and extends beyond this end to the frame member 2G.

Figure 6B:
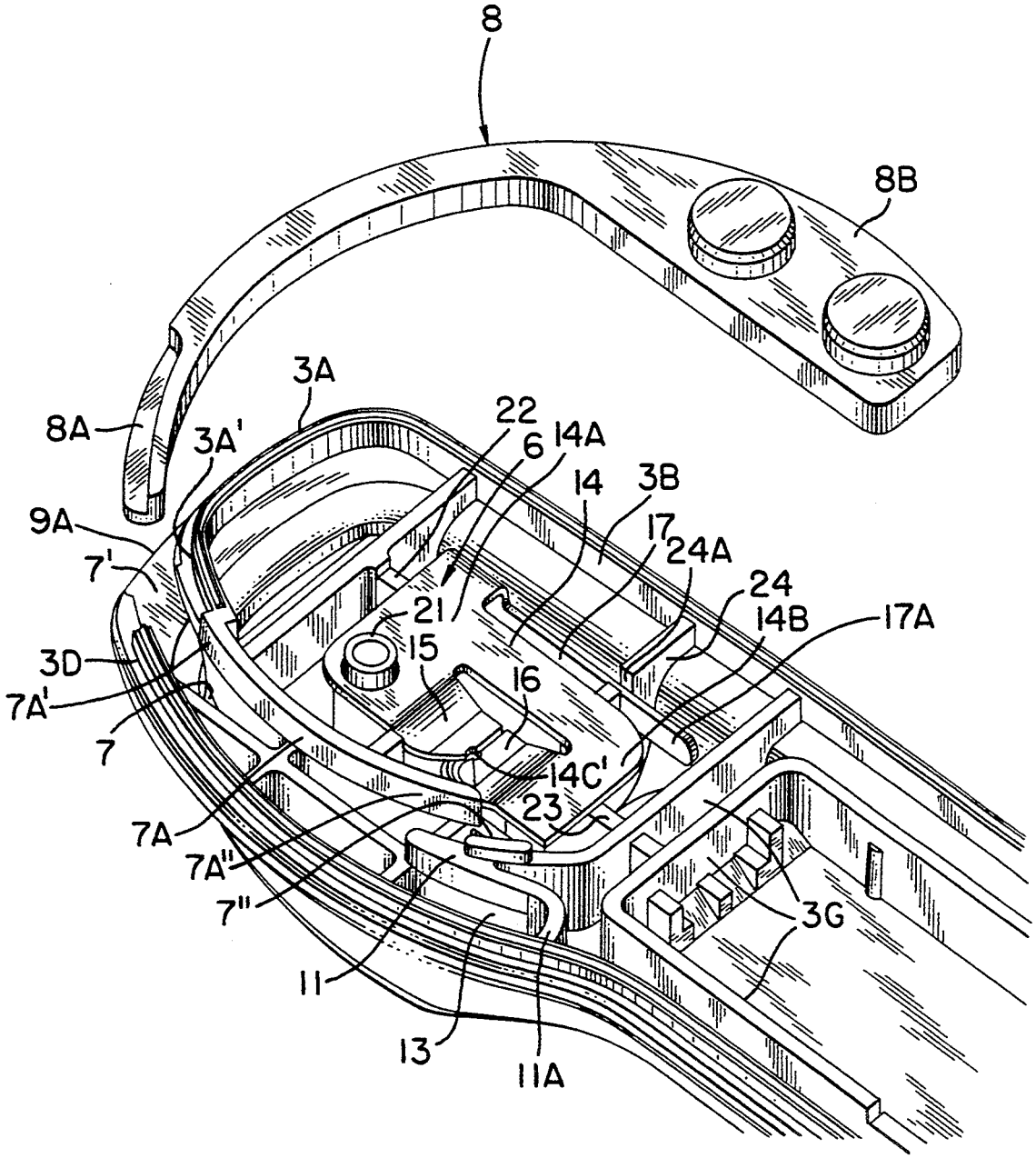
Figure 7:
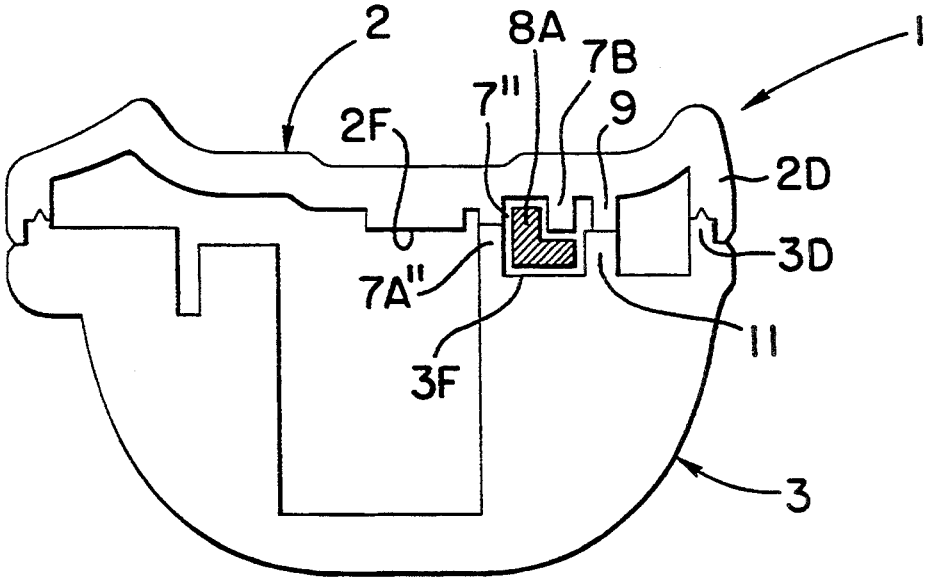
FIG. 7 is a cross section of the EAS tag of FIG. 1 taken along the line B—B in FIG. 1 with the probe inserted in the arcuate channel in the tag.

The presence of the wall 7B changes or alters the configuration of the channel 7 at its inner end 7'' which end lies adjacent the means 6 (see, FIG. 6B). This change or alteration in configuration defines a keyway for the channel 7 which must b accommodated by the probe 8 to pass through the channel and gain access to the means 6.

In the case illustrated, the wall 7B changes the channel cross section from substantially rectangular to substantially L-shaped. This is illustrated in the cross section of FIG. 7 which has been taken along the line B—B in FIG. 1 so that the cross section of the channel end 7'' is made visible.

FIGS. 6A and 6B are enlarged views of the section of the lower housing 3 containing the means 6 and the arcuate channel 7. In FIG. 6A, the arcuate probe 8 is shown as received in and guided by the channel 7 to the means 6 for the purpose of releasing same. As can be seen, the forward end 8A of the probe 8 is recessed so as to be L-shaped and, thus, fit within the L-shaped keyway defined by inner end 7'' of the channel. In FIG. 6B, the probe 8 is shown as withdrawn from the channel.

Adjacent the inner end 7'' of the channel 7, the lower and upper housings 2 and 3 are provided with further curved walls 9 and 11 which terminate in wall sections 9A and 11A abutting the end walls 2D and 3D. The walls 9 and 11 are outward of the channel 7 and, with the end walls 2D and 3D, define a trap area 13 which prevents access to the means 6. This area provides a safety measure for blocking unauthorized objects introduced into the channel 7 of the tag body 1A in an attempt reach the means 6.

As above-noted, the means 6 is adapted to releasably prevent the tack body 4B from being withdrawn from the tag body 1A. More particularly, in further accord with the invention, the means 6 is specifically adapted to accommodate release of the tack body 4B via the arcuate probe 8 moving in the arcuate channel 7. The means 6 is shown in detail in FIGS. 6A and 6B and in an exploded view in FIG. 5.

As shown, the means 6 is in the form of a spring clamp having a clamp body 14 and jaws 15 and 16. The clamp body includes a mounting part 14A extending laterally of the jaw 15 and a release part 14B extending laterally of the jaw 16. The mounting part 14A includes a mounting aperture 14A'.

Each of the jaws 15, 16 extends outwardly of the plane of the clamp body 14 and then inwardly toward the other jaw. The jaws 15, 16, furthermore, terminate in facing edges 15A and 16A. These edges extend from a common edge 14C of the clamp body 14 inwardly toward each other, then curve outwardly away from each other to define an aperture 14C' (typically, circular or elliptical) for receiving the tack body 4B. The edges 15A and 16A then continue in aligned fashion and end in an elongated, lateral slot 14D in the clamp body 14. The latter slot lies inward of a further clamp body edge 14E which opposes the clamp body edge 14C.

A further laterally extending elongated spring sleeve or arm 17 is attached by a joint area 18 to the side 14E' of the edge 14E bordering the mounting part 14A. The sleeve 17 extends along the length of the edge 14E and is also out of the plane of the clamp body.

For mounting and supporting the spring clamp 14, the lower housing 3 of the tag body 1A includes a hollow circular mount 21 with a lip 21A and support walls 22, 23 and 24 (see, FIGS. 2, 3, 6A and 6B). The clamp is mounted, via the aperture 14A' of the mounting part 14, on the mount 21 with the area of mounting part adjoining the aperture 14A' supported on the lip 21A. A circular wall 25 of the upper housing 3 and a central cylindrical stud 26 of this housing (see, FIGS. 2 and 4A) maintain the mounting part 14A in its mounted position, while allowing the mounting part to be rotated. The spring clamp 14 is thus able to pivot about the mounting part as will be described more fully below.

The back end 14A" of the mounting part 14A and the lateral part of the clamp connecting the mounting part 14A and the release part 14B are supported on the support walls 22 and 24, while the release part is carried by the wall 23. The spring sleeve 17 rests with one end 17A in a slot 24A in the support wall 24.

When the pointed end 4D of the tack body 4B is introduced in the downward direction through the opening 2H in the upper housing 2, the part 2K of the upper housing, which part is shaped to fit within the hollow of the spring clamp body 14 above the jaws 15, 16 and carries the opening 2H, directs the tack body to the aperture 14C' defined by the facing edges 15A, 16A of the jaws. This causes the jaws to spread or open and allow the tack body 4B to pass through the jaws.

When the downward tack travel is stopped at a desired slot 4C, i.e., a slot which provides a tight fit of the tack head 4A and article 51 to the wall 2E of upper housing 2, the jaws 15, 16 retract and clutch the tack body 4B. In this position, the jaws 15, 16 prevent upward movement of the tack 4. The tack 4 and article 51 thus become locked to the tag body 1A.

In order to release the tack 4 from the tag body 1A, the arcuate probe 8 is now introduced into the opening of the tag body 1A via rotation of the probe about its rearward end 8B. This causes the probe to be moved in and guided by the channel 7 until the L-shaped forward end 8A of the probe reaches and passes into the L-shaped inner end 7" of the channel 7. This brings the probe end 8A to the part of the common edge 14C bordering the release part 14B of the clamp body 14.

Continued rotational movement of the probe 8 then causes a on the release part 14B. This force, in turn, causes the clamp body 14 to rotate about the support area 14A on the mount 21. The jaws 15, 16 are thus enabled to spread apart or open due to the force of the tack body 4B, which is held stationary by the collar 3H, acting on the walls of the aperture 14C'. The aperture 14C' thus expands, releasing the tack body 4B from the grip or clutch of the jaws. The tack 4 can now be moved in the upward direction past the jaws, via an upward force on the tack head 4A, thereby withdrawing and separating the tack body 4B from the tag body 1A and the article 51 from the tag 1.

During rotation of the spring clamp body 14 as a result of the in-plane force exerted by the probe 8, the spring arm 17 at the joint 18 is compressed. After the tack 1 is separated from the tag body 1A, the probe 8 is rotated in the reverse direction. This reverse rotation disengages the probe from the release part 14A of the spring clamp 14 as the probe 8 is withdrawn from the channel 7. The force on the spring clamp 14 is thus removed and the spring arm 17 expands. This causes the spring clamp 14 to rotate in the opposite direction about the support area 14A. The spring clamp 14 is thereby brought back to its original position awaiting reentry of the tack body 4B for again attaching an article to the tag 1.

FIGS. 8–10 and 11–12 show two embodiments of detaching assemblies which incorporate the arcuate detaching probe 8. Each of these assemblies can be used to rotate the probe as above-described to detach the tack 4 from the tag 1.

Figure 8:
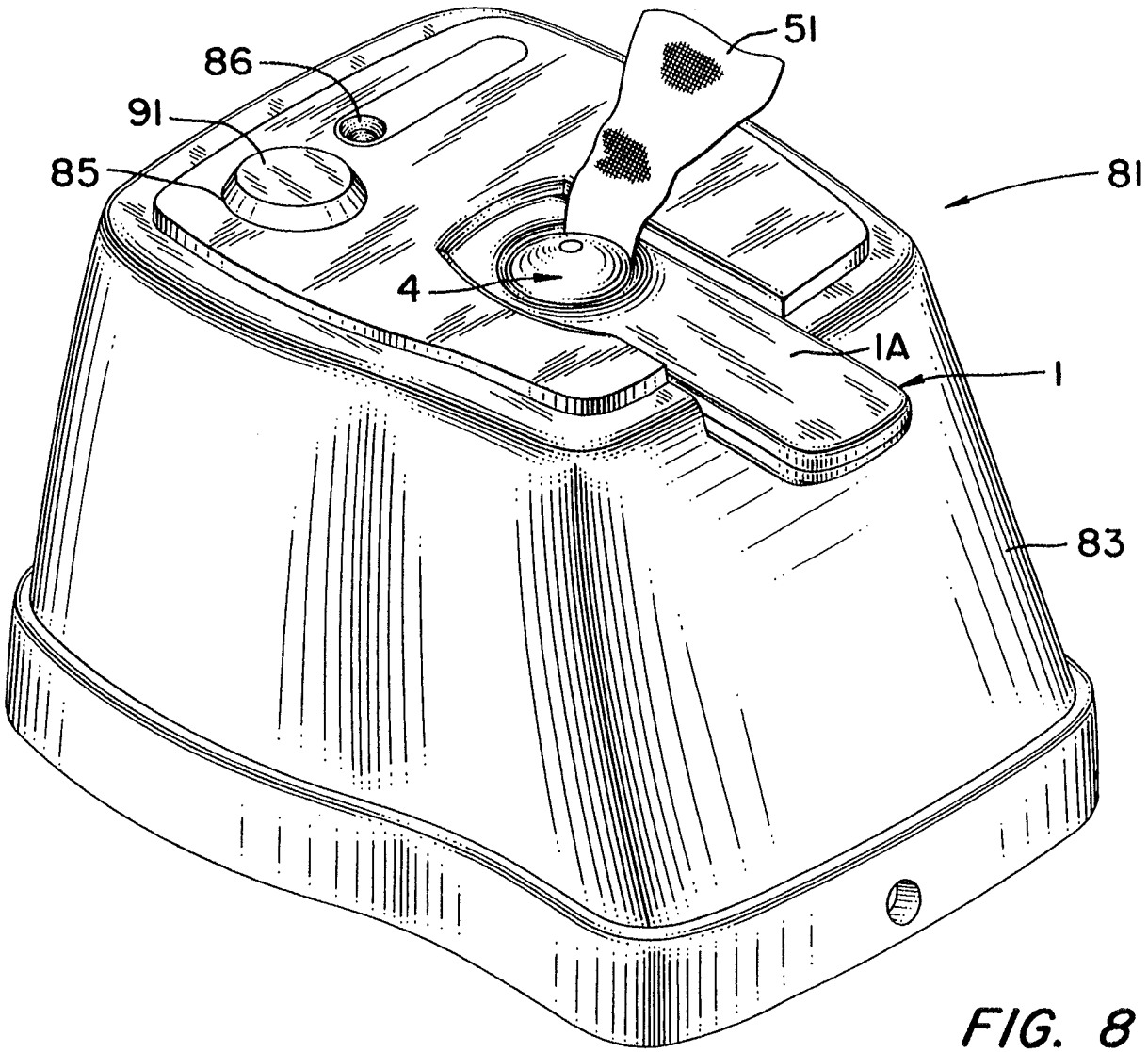
FIG. 8 shows a power actuated/tag activated detacher assembly for detaching the EAS tag of FIG. 1 from an article.
Figure 9:
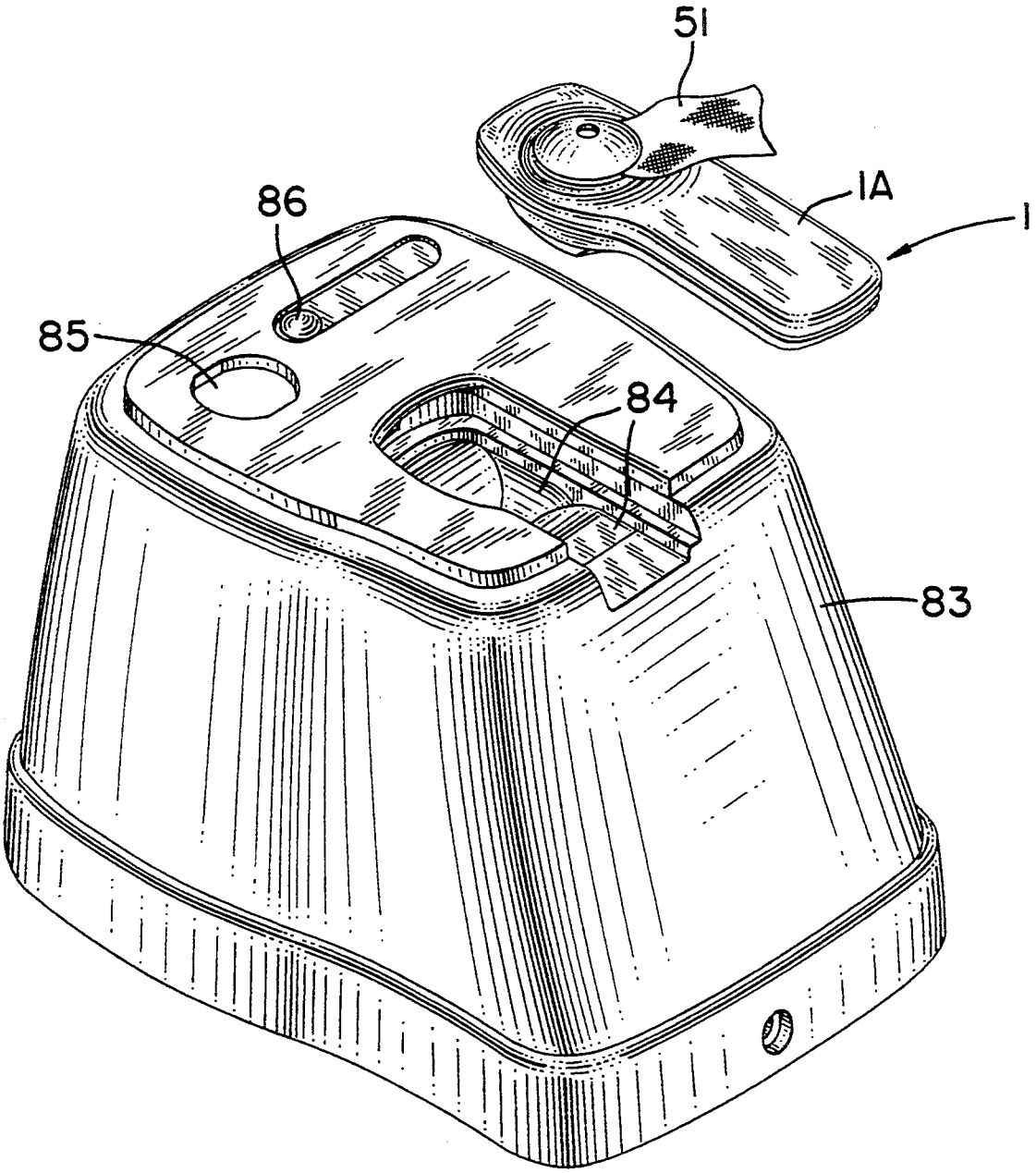
FIG. 9 shows the outer cover of the detacher assembly of FIG. 8.
Figure 10:
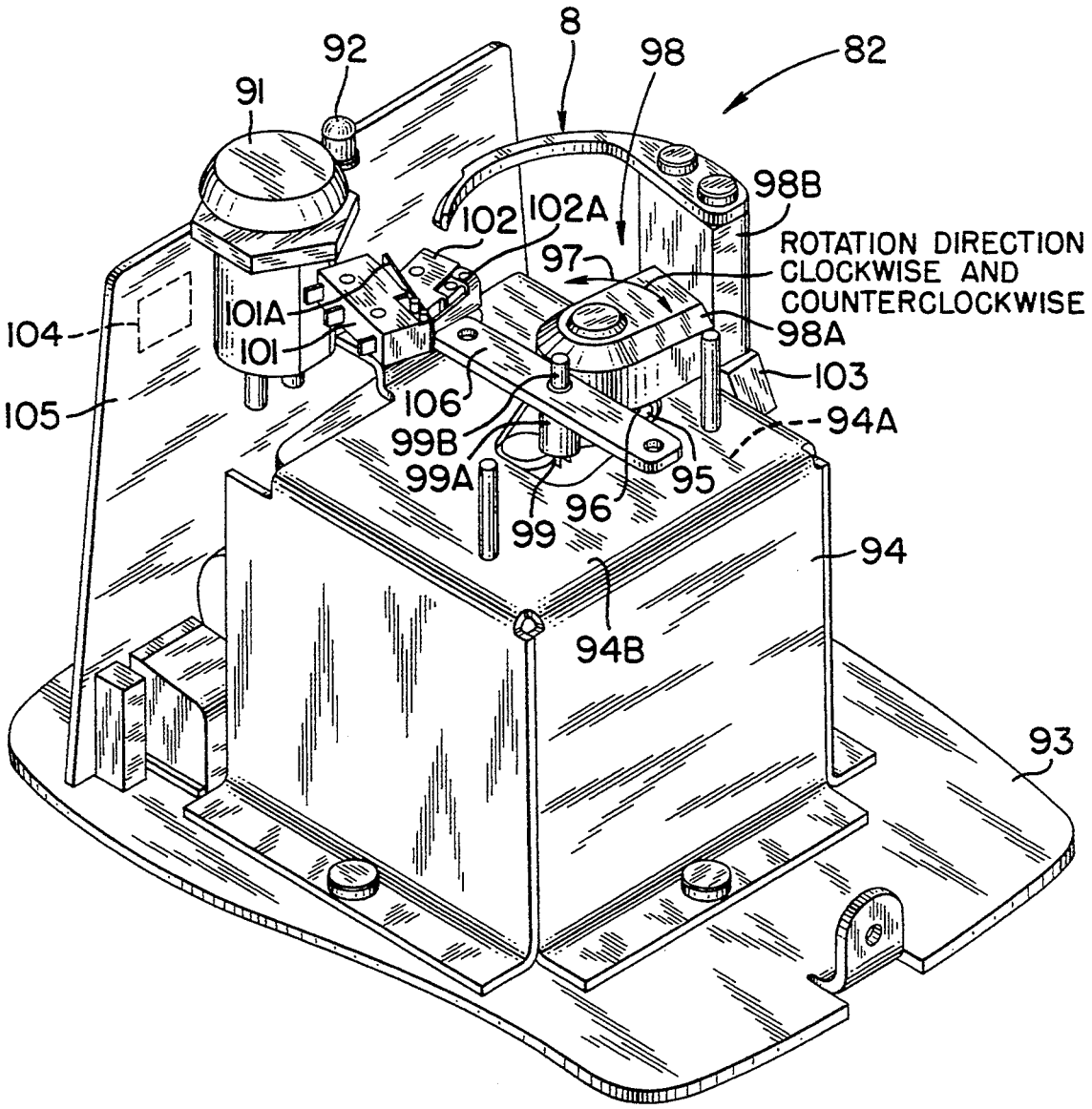
FIG. 10 shows the detaching mechanism of the detacher assembly of FIG. 8.

The detaching assembly 81 of FIGS. 8–10 is a power actuated/tag activated assembly and includes a detaching mechanism 82 (see, FIG. 10) which is covered by a removable detacher cover 83. As shown in FIGS. 8 and 9, the detacher cover 83 includes a nesting or cradle area 84 for receiving the tag body 1A of the tag 1. The cover 83 also includes an ON/OFF switch aperture 85 sized to accommodate an ON/OFF switch 91 of the detaching mechanism 82. A further aperture 86 of the cover 83 receives a light emitting diode (LED) 92 which indicates the on/off status of the detaching mechanism.

As shown in FIG. 10, the detaching mechanism 82 includes a frame or bottom plate 93 to which is affixed a motor cover 94 having in its upper surface 94B an opening 95. The motor cover 94 houses a motor 94A supported on the plate 93. The motor 94A drives an upstanding shaft 96 which projects out of the opening 95 and is rotatable in either a clockwise or counterclockwise direction as desired (indicated by arrows 97).

A rotatable member 98 has a base 98A which is fixedly attached to an upstanding section 98B. The base 98A is coupled to the shaft 96 and it and the upstanding section 98B rotate with the rotation of the shaft. The upstanding section 98B carries the rearward end 8B of the arcuate probe 8 and rotation of the section 98B causes rotation of the probe 8, as above-described.

In order to effect automatic rotation of the probe 8 from an initial position (shown in FIG. 10) to a detachment position (shown in FIG. 6A) and then back to its initial position, the detaching mechanism 82 is additionally provided with first and second activator switches 99 and 101, a reverse switch 102 and a home switch 103. These switches provide signals over lines (not shown) to control electronics 104 mounted on a PC board 105 attached to the base 93. The control electronics 104, in turn, provide drive signals to the motor 94A for driving same to realize movement of the probe arm 8, as above-described.

As shown, the activator switch 99 is mounted on the upper surface 94B of the of the motor cover 94 and includes a body 99A which supports a platform element 106. A spring biased upstanding plunger 99B of the switch 99 extends from the body 98A through the platform element 106 and movement of the plunger 99B downward causes activation of the switch 99. The second activator switch 101 is also mounted to the motor cover 94, but at the forward end of the platform element 106. The switch 101 includes an outwardly extending reed element 101A which when engaged causes activation of the switch.

When the tag 1 is properly mounted in the cradle area 84 of the cover 83, both the plunger 99B of the switch 99 and the reed element 101A of the switch 101 become engaged. This results in simultaneous activation of both the switches 99 and 101, causing simultaneous activation signals to be present at the control electronics 104. The control electronics recognizes this activated condition as signifying that a tag 1 is properly situated in the detacher assembly. It thereupon signals the motor to counterclockwise rotate to move the probe 8 counterclockwise from its initial position into the tag body.

The reverse switch 102 is affixed to the motor cover 94 and has a reed element 102A extending toward the base 98A and positioned to be engaged by the base when the counterclockwise moving probe 8 reaches its detachment position, i.e., its position as shown in FIG. 6A. Activation of the reverse switch by engagement of the reed element 102A causes a further signal to be received by the control electronics 104, indicating that the probe 8 has effected detachment and that the motor rotation should be reversed to withdraw the probe from the tag body. The motor drive signal is changed accordingly and the motor reversed. This causes the base 98A and section 98B to be clockwise rotated, likewise clockwise rotating the probe 8 bringing it out of the tag and back to its initial or starting position.

The home switch 103 is affixed to the motor cover 94 adjacent the upstanding section 98B. As the base 98A and upstanding section 98B are clockwise rotated, a reed element (not shown) on the switch 103 is engaged by the base 98A as the probe 8 returns to its initial position. This results in the home switch 103 signaling the control electronics 104 that the probe 8 has reached this position. The control electronics 104 then adjusts the drive signals to the motor so that the motor rotation stops and the probe 8 is brought to rest at the initial position.

Figure 11:
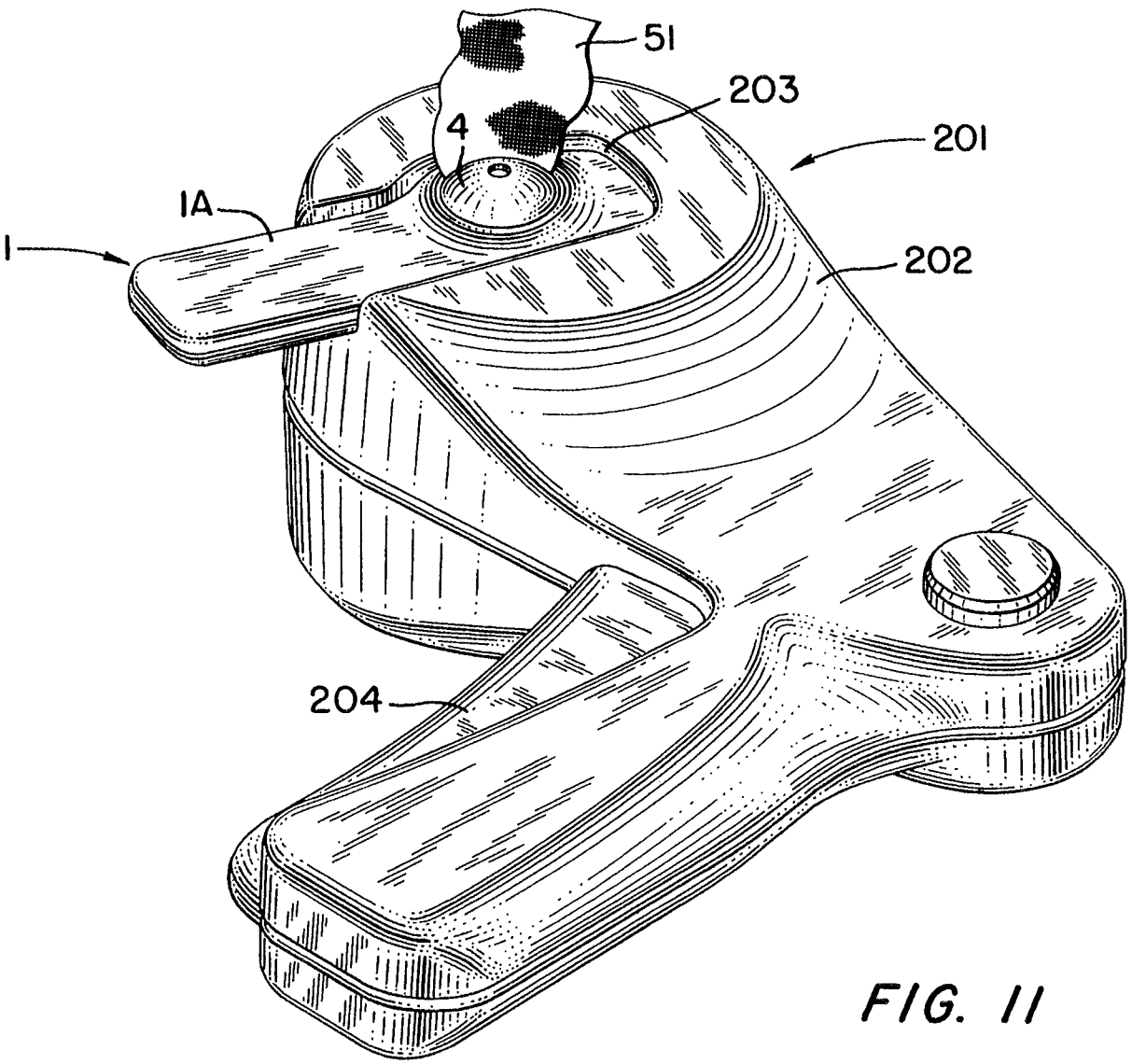
FIG. 11 shows a hand actuated detacher assembly for detaching the EAS tag of FIG. 1 from an article.
Figure 12:
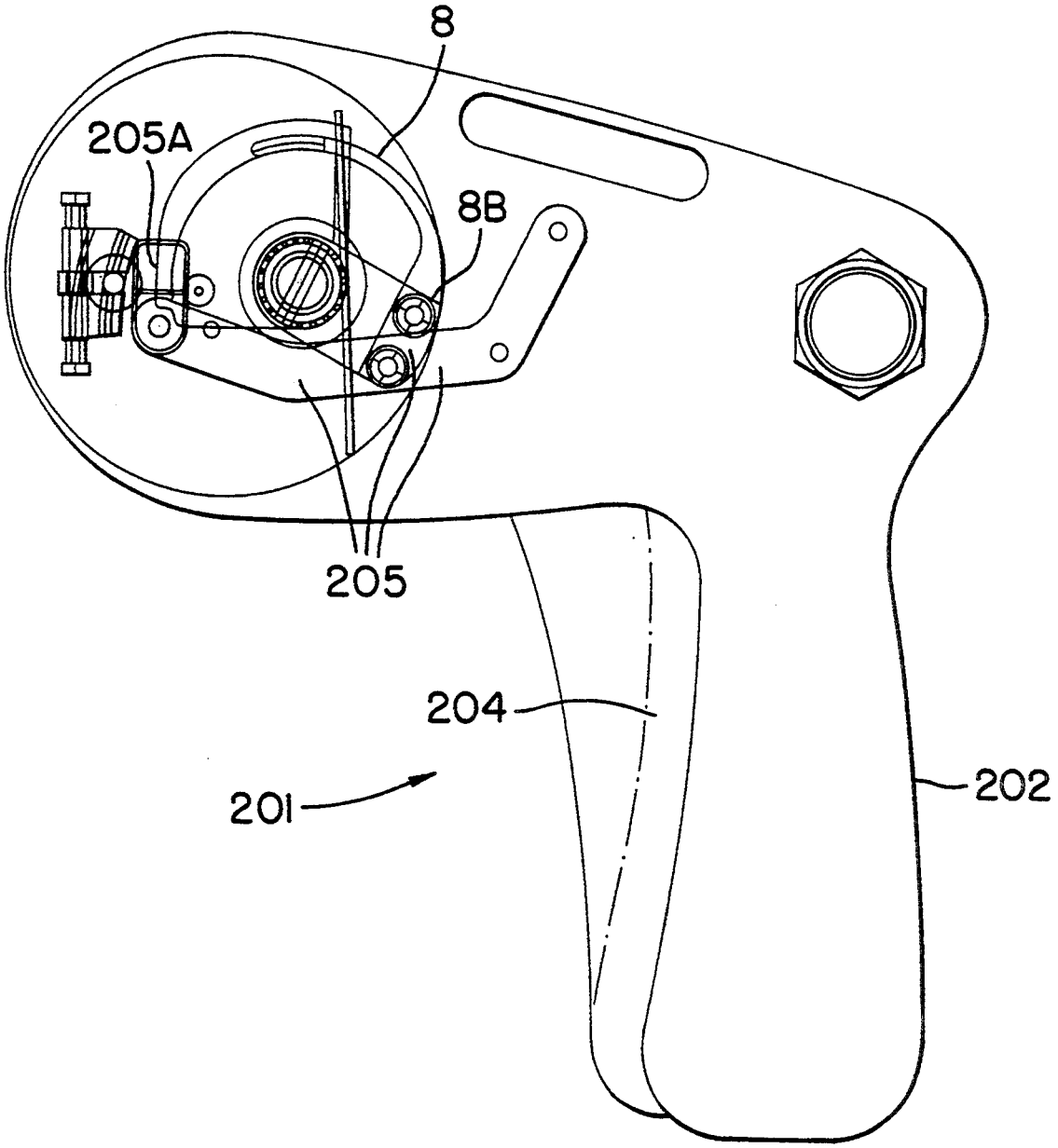
FIG. 12 shows the detaching mechanism of the detacher assembly of FIG. 11.

FIGS. 11 and 12 show a second detaching assembly 201 usable to detach the tag 1 from the article 51. In this case, the detacher is hand actuated and includes an outer housing 202 having a nesting area 203 for supporting the tag 1. A trigger 204 is carried by the housing 201 for actuating the detacher and releasing the tag 1 from the article 51.

As shown in FIG. 12, the detaching assembly 201 includes an internal linkage mechanism 205 which is coupled to the trigger 204. The linkage mechanism 205 carries the arcuate probe 8 via its base 8B and is adapted to rotate the probe counterclockwise to a detach position 205A when the trigger 204 is actuated. In this position, the probe 8 has entered the tag body, traversed the channel 7 and detached the pin 4 as shown in FIG. 6A.

After detachment has occurred, the trigger 204 is released. The linkage mechanism 205 then rotates the probe 8 clockwise, withdrawing it from the tag body and returning the probe to its initial position as shown in FIG. 12.

Figure 13:
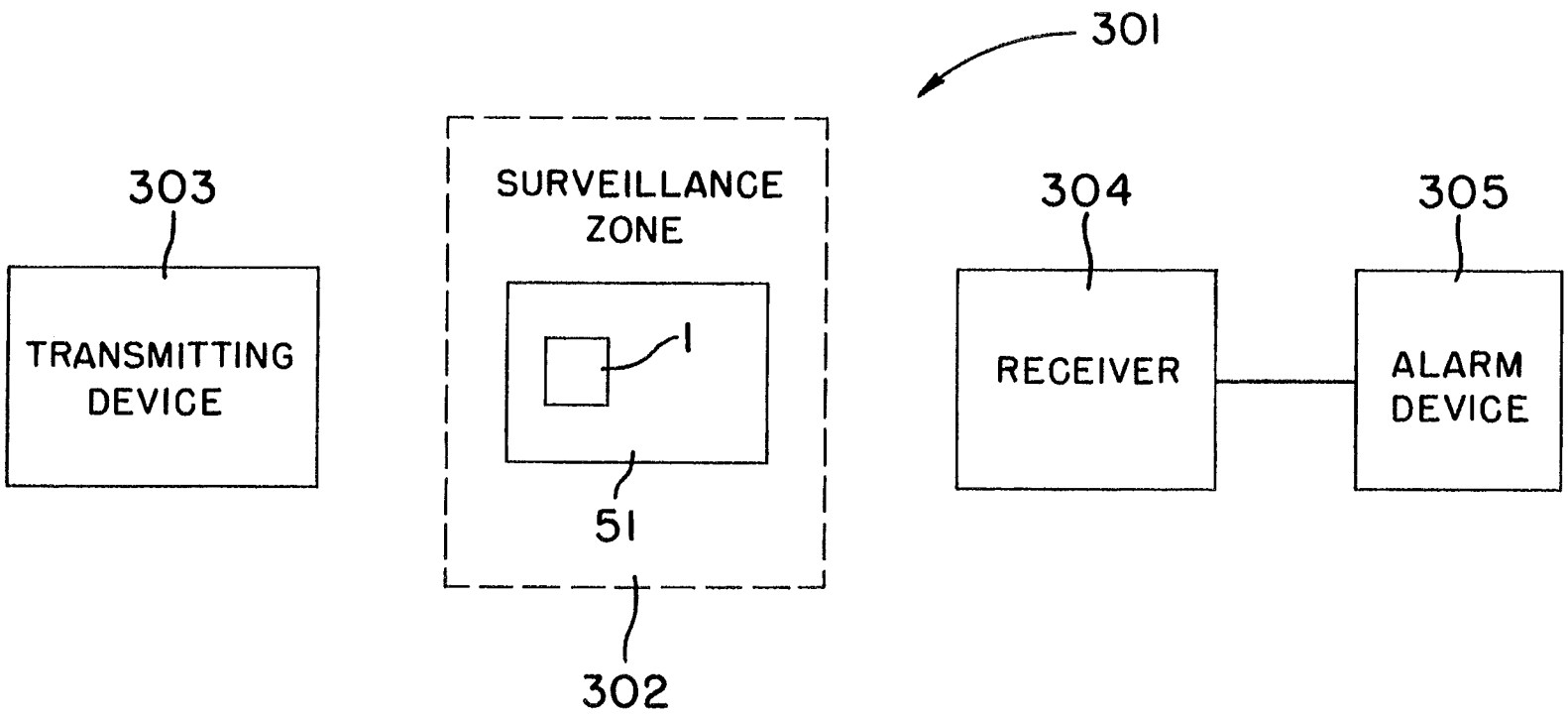
FIG. 13 shows an electronic article surveillance system for use in conjunction with the EAS tag of FIG. 1.

FIG. 13 shows an EAS system 301 used to detect or sense the tag 1 when passing through a surveillance zone 302. An interrogation signal is transmitted into the zone 302 via a transmitting device 303. A signal resulting from interaction of the sensor 5 in the tag 1 with the transmitted signal is received at a receiver 304 which communicates with a detection and alarm device 305. The latter detects the received signal and generates an alarm indicating the presence of the tag 1 and the article 51 in the surveillance zone 302.

The particular configurations used for the devices 303, 304 and 305 in the system 301 will depend on the particular nature of the sensor. For the types of sensors disclosed in the above-mentioned patents, devices of the types also disclosed in these patents can be used.

It should be noted that the spring clamp 14 of the tag 1 can be constructed of spring sheet metal. The probe 8, in turn, can be constructed of hardened tool steel.

In all cases it is understood that the above-described arrangements are merely illustrative of the many possible specific embodiments which represent applications of the present invention. Numerous and varied other arrangements can be readily devised in accordance with the principles, of the present invention without departing from the spirit and scope of the invention. Thus, for example, the spring clamp release means 6 shown in FIG. 5 might be used with EAS tags of a construction which differ in one or more respects from that of the EAS tag 1 and which need not include an arcuate channel or be responsive to an arcuate detaching probe.

What we claim is:

1. An EAS tag comprising:

a tag body;

means for attaching said tag body to an article, said attaching means having a part which is received in said tag body;

means within said tag body for releasably preventing said part of said attaching means from being withdrawn from said tag body;

means within said tag body defining an arcuate channel leading from the exterior of said tag body to said preventing means, said arcuate channel being adapted to receive and guide an arcuate probe to said preventing means for releasing said preventing means from preventing said part of said attaching means from being withdrawn from said tag body;

and an detectable EAS sensor.

2. An EAS tag in accordance with claim 1 wherein:

said tag body has first and second openings leading into the interior of said tag body;

said attaching means includes a tack assembly having a tack head and an elongated tack body, said tack body being received in said first opening of said tag body and forming the part of the attaching means received in the tag body;

said preventing means includes means within the tag body for releasably receiving and clutching the tack body when the tack body is introduced into said tag body through said first opening, said receiving and clutching means upon receiving and clutching said tack body preventing withdrawal of said tack body from said tag body and including a release part which is adapted to be engaged by said arcuate probe to cause said receiving and clutching means to release clutching said tack body to permit said tack body to be withdrawn from said tag body;

and said arcuate channel leads from said second opening in said tag body to said release part of said receiving and clutching means, whereby said arcuate probe when introduced into said arcuate channel is brought into engagement with said release part of said receiving and clutching means to cause said receiving and clutching means to release clutching said tack body to allow withdrawal of said tack body from said tag body.

3. An EAS tag in accordance with claim 2 wherein:

said arcuate channel has a first predetermined configuration over a first length of said arcuate channel leading from said second opening and a second predetermined configuration over a second length of said arcuate channel terminating adjacent said release part of said receiving and clutching means.

4. An EAS tag in accordance with claim 3 wherein:

said first predetermined configuration is substantially of rectangular cross section;

and said second predetermined configuration is substantially of L-shaped cross section.

5. An EAS tag in accordance with claim 2 further comprising:

further means within said tag body defining a further channel adjacent to and outward of said arcuate channel, said further channel extending from adjacent to said release part of said receiving and clutching means and inhibiting access to said release part of said receiving and clutching means.

6. An EAS tag in accordance with claim 5 wherein: said arcuate channel defining means and said further channel defining means each are formed by one or more walls interior of said tag body.

7. An EAS tag in accordance with claim 2 wherein: said tag body comprises: first and second elongated housings, each of said first and second elongated housings including first, second, third and fourth side walls and a further wall joining said first, second, third and fourth side walls, said first, second, third and fourth side walls of said first elongated housing mating with said first, second, third and fourth side walls of said second elongated housing, respectively, and said first opening extending from an outer surface of and through said further wall of said first elongated housing and said second opening extending from outer surfaces of mating side walls of said first and second elongated housings.

8. An EAS tag in accordance with claim 7 wherein: the outer surface of said further wall of said first elongated housing in the area of said first opening is recessed;

and said tack head seats in said recessed area when said tack body is received and clutched by said receiving and clutching means.

9. An EAS tag in accordance with claim 8 wherein: said tack body has a pointed forward end which passes through said receiving and clutching means when said tack body is clutched by said receiving and clutching means;

and an inner surface of said further wall of said second elongated housing has an aperture for receiving said pointed forward end of said tack body.

10. An EAS tag in accordance with claim 7 further comprising:

a mounting means attached to an inner surface of said further wall of said second elongated housing for mounting said receiving and clutching means such that said receiving and clutching means receives said tack body passing into said first opening and through said further wall of said first elongated housing and such that said receiving and clutching means upon engagement of said release part of said receiving and clutching means by said arcuate probe is rotated from a first position.

11. An EAS tag in accordance with claim 10 further comprising:

means for returning said receiving and clutching means to said first position upon disengagement of said arcuate probe from said receiving and clutching means.

12. An EAS tag in accordance with claim 10 wherein: said receiving and clutching means is rotationally mounted to said mounting means at a mounting part of said receiving and clutching means, said mounting part being off-set laterally from said release part.

13. An EAS tag in accordance with claim 12 wherein: said receiving and clutching means comprises: a spring clamp having a clamp body having first and second parts; and jaws comprising first and second jaw sections attached to said first and second parts, respectively, of said clamp body, said first part of said clamp body forming said mounting part of said receiving and clutching means and said second part of said clamp body forming said release part of said receiving and clutching means, said spring clamp being mounted at said first part so that when said tack body passes into said first opening and through said further wall of said first elongated housing in a first direction said tack body is received in and causes said first and second jaw sections of said jaws of said spring clamp to open, said first and second jaw sections of said jaws of said spring clamp gripping said tack body and preventing said tack body from being withdrawn from said jaws when said tack body is moved in a second direction opposite said first direction, said spring clamp being further mounted at said first part of said clamp body so that said clamp body pivots about said first part and said second part of said clamp body being adapted to receive a torsional force acting on said second part of said clamp body when said second part of said clamp body is engaged by said arcuate probe to cause said clamp body to pivot about said first part of said clamp body, said first and second jaw sections of said jaws of said spring clamp being configured such that said rotating of said clamp body about said first part of said clamp body caused by said torsional force acts to cause said first and second jaw sections of said jaws to open so as to release said tack body and permit withdrawal of said tack body from said first and second jaw sections of said jaws and said tag body in said second direction.

14. An EAS tag in accordance with claim 13 further comprising:

a spring means affixed to said spring clamp;

and an abutment affixed to said inner surface of said second elongated housing, said abutment being in engagement with said spring means.

15. An EAS tag in accordance with claim 13 further comprising:

a first curved inner wall attached to said inner surface of said second elongated housing and extending from adjacent said second opening past said first part of said clamp body to adjacent said second part of said clamp body, said first curved inner wall forming a part of said arcuate channel defining means.

16. An EAS tag in accordance with claim 15 further comprising:

a second curved inner wall attached to said inner surface of said first elongated housing, said second curved inner wall being displaced outward from said first curved inner wall and extending along a part of said first curved inner wall to adjacent said second part of said clamp.

17. An EAS tag in accordance with claim 13 wherein: said first and second law sections of said jaws are integrally formed with said first and second parts of said clamp body and terminate in spaced facing edges, said spaced facing edges of said first and second jaw sections extending from a common first edge of said clamp body.

18. An EAS tag in accordance with claim 17 wherein: said spaced facing edges of said first and second jaw sections extend from said common first edge of said clamp body inwardly toward each other, then curve to define an aperture for receiving said tack body and then terminate inwardly of a second edge of said clamp body.

19. An EAS tag in accordance with claim 18 wherein:

said first part of said clamp body extends to said common first edge and outward of said first section;

and said second part of said clamp body extends to said common first edge and outward of said second jaw section.

20. An EAS tag in accordance with claim 19 wherein: said first part includes an aperture by which said clamp body is mounted.

21. An EAS tag in accordance with claim 20 further comprising:

a spring arm extending along the length of said second edge of said clamp body; and a curved joint joining said spring arm to an end of said second edge of said clamp body adjacent said first part of said clamp body.

22. An EAS tag in accordance with claim 2 wherein: said tag body is formed of a hard plastic.

23. An EAS tag in accordance with claim 22 wherein: said hard plastic is an injection molded ABS plastic.

24. An EAS tag in accordance with claim 2 wherein: said arcuate channel defining means is formed by one or more inner walls of said tag body.

25. An EAS tag in accordance with claim 1 wherein: said tag body is formed of a hard plastic.

26. An EAS tag in accordance with claim 25 wherein: said hard plastic is an injection molded ABS plastic.

27. A spring clamp for use in releasably clamping an EAS article attaching means to an EAS tag body comprising:

a clamp body having first and second parts;

jaws comprising first and second jaw sections attached to said first and second parts, respectively, of said clamp body;

said first part of said clamp body being adapted to mount said clamp body to an EAS tag body so that said clamp body pivots about said first part of said clamp body;

said second part of said clamp body being adapted to receive a torsional force acting on said second part of said clamp body to cause said clamp body to pivot about said first part of said clamp body;

and said first and second jaw sections of said jaws being configured such that said pivoting of said clamp body about said first part of said clamp body caused by said torsional force acts to cause said first and second jaw sections of said jaws to open from a closed position, whereby when said clamp body is mounted to said EAS tag body and said first and second jaw sections of said jaws are in said closed position and gripping an EAS article attaching means, thereby clamping said EAS tag body to said EAS article attaching means, said opening of said first and second jaw sections from said closed position releases said grip of said first and second jaw sections on said EAS article attaching means to permit withdrawal of said EAS article attaching means from said first and second jaw sections, thereby releasing said EAS tag body from said EAS article attaching means.

28. A spring clamp in accordance with claim 27 wherein:

said first and second jaw sections of said jaw are integrally formed with said first and second parts of said clamp body and terminate in spaced facing edges, said spaced facing edges of said first and second jaw sections extending from a common first edge of said clamp body.

29. A spring clamp in accordance with claim 28 wherein:

said spaced facing edges of said first and second jaw sections extend from said common first edge of said clamp body inwardly toward each other, then curve to define an aperture for receiving said tack body and then terminate inwardly of a second edge of said clamp body.

30. A spring clamp in accordance with claim 29 wherein:

said first part of said clamp body extends to said common first edge and outward of said first jaw section;

and said second part of said clamp body extends to said common first edge and outward of said second jaw section.

31. A spring clamp in accordance with claim 30 wherein:

said first part of said clamp body includes an aperture by which said clamp body is mounted.

32. A spring clamp in accordance with claim 31 further comprising:

a spring arm extending along the length of said second edge of said clamp body;

and a curved joint joining said spring arm to an end of said second edge of said clamp body adjacent said first part of said clamp body.

33. A detaching device for use in detaching an EAS from an article, said EAS tag including: a tag body; means for attaching said tag body to an article, said attaching means having a part which is received in said tag body; means within said tag body for releasably preventing said part of said attaching means form being withdrawn from said tag body; means within said tag body defining an arcuate channel leading from the exterior of said tag body to said preventing means; and an EAS sensor; said detaching device comprising:

an arcuate probe configured to be received in and guided by said arcuate channel of said tag body; and means for moving said arcuate probe, whereby said arcuate probe is introduced into and guided by said arcuate channel to said preventing means in said tag body for releasing said preventing means from preventing said part of said attaching means from being withdrawn for said tag body, said arcuate probe being withdrawn from said tag body through said arcuate channel.

34. A detaching device in accordance with claim wherein:

said means for moving said probe causes said probe to rotate.

35. A detaching device in accordance with claim 34 further comprising:

means for mounting said EAS tag relative to said arcuate probe, whereby rotation of said arcuate probe in first and second opposite rotation directions by said moving means results in said probe being introduced into and guided by and being withdrawn from said arcuate channel of said tag body.

36. A detaching device in accordance with claim 35 wherein said moving means is hand actuated.

37. A detaching device in accordance with claim 36 further comprising:

a hand actuated trigger;

and mechanical linkage means linking said hand actuated trigger to said moving means.

38. A detaching device in accordance with claim 35 wherein said moving means is actuated by said EAS tag.

39. A detaching device in accordance with claim 38 wherein:

said moving means includes: motor means coupled to said arcuate probe for rotating said arcuate probe in said first and second directions; and electronics means for controlling said motor means including means for sensing the position of said tag body and the position of said arcuate probe.

40. A detaching device in accordance with claim 39 wherein:

said means for sensing the position of said tag body and the position of said arcuate probe includes: a first sensor for sensing one or more parts of said tag body upon said EAS tag being mounted on said mounting means, said first sensor upon sensing the presence of said one or more parts of said tag body causing said electronics means to control said motor means to rotate said arcuate probe in said first direction from a first position to cause said arcuate probe to pass into said arcuate channel; a second sensor for sensing when said arcuate probe has moved to a second position upon rotation of said arcuate probe in said first direction, said second sensor upon sensing that said arcuate probe has moved to said second position causing said electronics means to control said motor means to rotate said arcuate probe in said second direction to cause said probe to be withdrawn from said arcuate channel; and a third sensor for sensing when said arcuate probe has moved to said first position upon rotation of said arcuate probe in said second direction, said third sensor upon sensing that said arcuate probe has moved to said first position causing said electronics means to control said motor means to stop rotation of said arcuate probe.

41. A detaching device in accordance with claim 34 wherein:

said arcuate probe has a first cross section over a first length of said arcuate probe and a second cross section over a second length of said arcuate probe.

42. A detaching device in accordance with claim 41 wherein:

said first cross section is substantially rectangular; and said second cross section is substantially L-shaped.

43. A detaching device in accordance with claim 42 wherein:

said second length is at the forward end of said probe.

44. A method of detaching an EAS tag from an article, said EAS tag comprising: a tag body; means for attaching said tag body to an article, said attaching means having a part which is received in said tag body; means within said tag body for releasably preventing said part of said attaching means from being withdrawn from said tag body; and means within said tag body defining an arcuate channel leading from the exterior of said tag body to said preventing means; said method comprising:

providing an arcuate probe configured to be received in and guided by said arcuate channel of said tag body;

and moving said arcuate probe, whereby said arcuate probe is introduced into and guided by said arcuate channel to said preventing means in said tag body for releasing said preventing means from preventing said part of said attaching means from being withdrawn from said tag body, and said arcuate probe is withdrawn from said tag body through said arcuate channel.

45. A method in accordance with claim 44 wherein:

said moving of said arcuate probe includes rotating said arcuate probe.

46. An EAS system comprising:

an EAS tag attached to an article; said EAS tag comprising: a tag body; means for attaching said tag body to an article, said attaching means having a part which is received in said tag body; means within said tag body for releasably preventing said part of said attaching means from being withdrawn from said tag body; means within said tag body defining an arcuate channel leading from the exterior of said tag body to said preventing means, said arcuate channel being adapted to receive and guide an arcuate probe to said preventing means for releasing said preventing means from preventing said part of said attaching means for being withdrawn from said tag body; and an EAS sensor;

means for transmitting a first signal into a surveillance zone; and means for receiving a tag signal resulting from the interaction in said zone of said first signal with EAS sensor in said tag for detecting the presence of said tag and article in said zone.

* * * * *

UNITED STATES PATENT AND TRADEMARK OFFICE

CERTIFICATE OF CORRECTION

PATENT NO. : 5,426,419

DATED : June 20, 1995

INVENTOR(S) : Thang T. Nguyen et al.

It is certified that error appears in the above-indentified patent and that said Letters Patent is hereby corrected as shown below:

Col. 5, line 29 Change "provide" to -- provided --.

Col. 5, line 31 Change "4B" to --4 and--.

Col. 10, line 22 Delete "detectable".

Col. 14, line 28 After "EAS" insert -- tag --.

Col. 14, line 33 Change "form" to -- from --.

Col. 14, line 46 Change "for" to -- from --.

Col. 14, line 50 After "claim" insert -- 33 --.

Col. 14, line 64 After "wherein" insert -- : --.

Col. 15, line 4 After "wherein" insert -- : --.

Col. 16, line 43 Change "for" to -- from --.

Col. 16, line 48 After "with" insert -- said --.

UNITED STATES PATENT AND TRADEMARK OFFICE

CERTIFICATE OF CORRECTION

PATENT NO. : 5,426,419

DATED : June 20, 1995

INVENTOR(S) : Thang T. Nguyen et al.

It is certified that error appears in the above-indentified patent and that said Letters Patent is hereby corrected as shown below:

Col. 5, line 30, insert —4B— after body; and Col. 5, line 32, after tag insert —1—.

Signed and Sealed this

Seventeenth Day of October, 1995

*Attest:*

*Attesting Officer*

BRUCE LEHMAN

*Commissioner of Patents and Trademarks*